United States Patent [19]

Rehberger

[11] Patent Number: 4,465,994

[45] Date of Patent: Aug. 14, 1984

[54] ADJUSTABLE ENCLOSED POTENTIOMETER

[75] Inventor: Tomaž Rehberger, Šentjernej, Yugoslavia

[73] Assignee: Iskra-Sozd Elektrokovinske Industrije n.sol.o, Ljubljana, Yugoslavia

[21] Appl. No.: 362,657

[22] Filed: Mar. 29, 1982

[30] Foreign Application Priority Data

Mar. 30, 1981 [YU] Yugoslavia ..... 835/81
Mar. 4, 1982 [YU] Yugoslavia ..... 479/82

[51] Int. Cl.[3] ..... H01C 10/32

[52] U.S. Cl. ..... 338/164; 338/184; 338/199

[58] Field of Search ..... 338/164, 162, 184, 199, 338/174, 160, 163

[56] References Cited

U.S. PATENT DOCUMENTS 2,887,553 5/1959 Glueckstein et al. ..... 338/184 X
2,943,288 6/1960 Budd ..... 338/184
3,197,726 7/1965 Hulbert ..... 338/184 X
3,413,588 11/1968 Ferrell ..... 338/164 X
3,760,323 9/1973 Lifson ..... 338/174
3,947,800 3/1976 Van Benthuysen et al. ... 338/174 X
3,970,986 7/1976 Seyler et al. ..... 338/184 X
3,997,865 12/1976 George ..... 338/184 X

FOREIGN PATENT DOCUMENTS 1937989 2/1970 Fed. Rep. of Germany .
2519051 11/1975 Fed. Rep. of Germany .

*Primary Examiner*—C. L. Albritton
*Attorney, Agent, or Firm*—Fleit, Jacobson, Cohn & Price

[57] ABSTRACT

The potentiometer is completely enclosed by a housing made of insulating material, of which material also the axle is made, so that the wiper is completely insulated. The potentiometer is dust-proof sealed and can either be adjusted manually or automatically with a screwdriver, or an additional axle can be inserted. The potentiometer can be mounted directly to the printed circuit board.

20 Claims, 4 Drawing Figures

ADJUSTABLE ENCLOSED POTENTIOMETER

Figure 1:
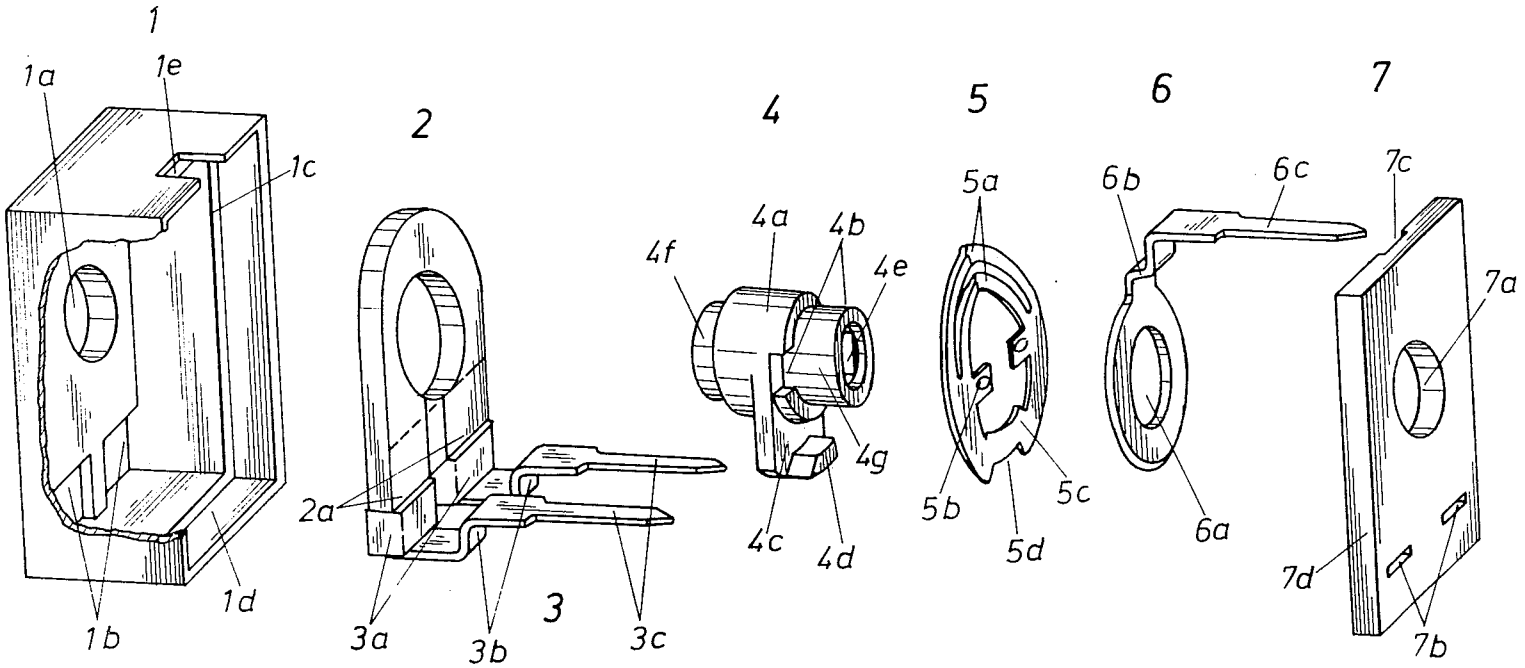

Object of the invention is an adjustable enclosed potentiometer of a small embodiment adapted to be used in electronic circuits and to be mounted directly to a printed circuit board.

Known is an adjustable enclosed potentiometer according to the published German patent application No. 19 37 989, on the bottom of whose housing a resistance ring is fixed over which moves a wiper which is fixed to a button. On one side the button is pivoted in the housing and on the other side it is pivoted in the cover of the housing, which at the same time serves as a wiper connector.

Another known potentiometer of this type is described in the published German patent application No. 25 19 051. The construction is similar, characterizing for both potentiometers it being that the housing is closed with the wiper connector, which in this way represents a part of the housing. Consequently, this connector has a large surface and is not insulated.

The third known solution of a potentiometer has the disadvantage that its wiper is not insulated. The tool for adjusting the potentiometer directly contacts the wiper, which can cause disturbances in the electronic circuit, at the same time the potentiometer is not properly sealed.

The aim of the invention is to provide an adjustable enclosed potentiometer without the disadvantages of known solutions, it first of all having a low contact and noise resistance, a big rotation angle, the ability of being adjusted from both sides, an insulated wiper, a dust-proof sealing and the feature to be adjustable manually or automatically.

According to the invention this aim is attained by an adjustable enclosed potentiometer into whose housing there are inserted a sliding ring without contacts and a pivoted shaft onto which a wiper with a connector is put and the housing of which is closed with a cover.

Figure 2:
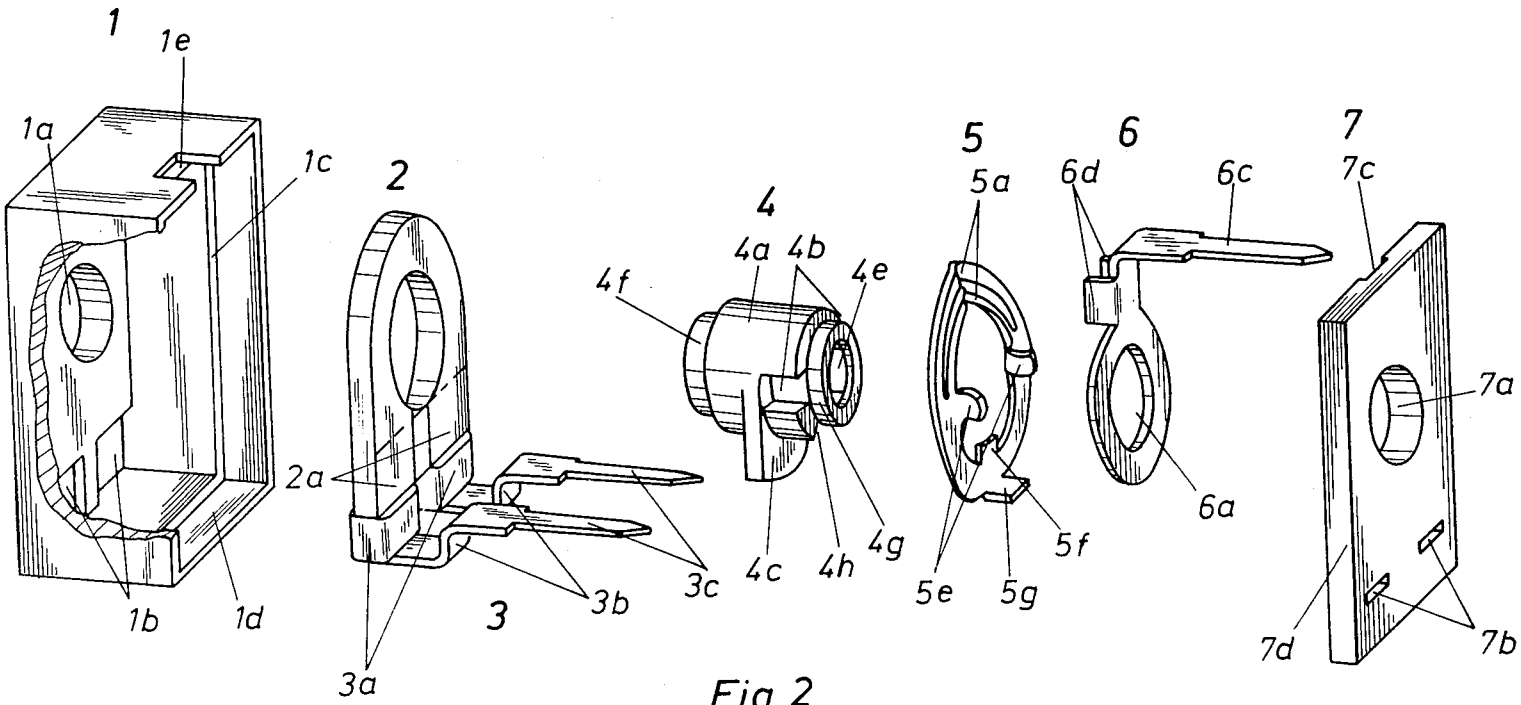
Figure 3:
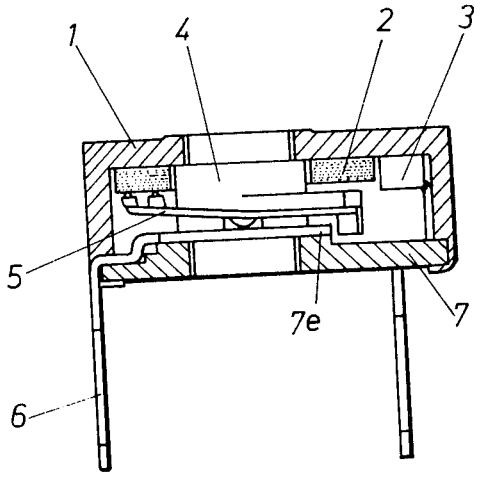
Figure 4:
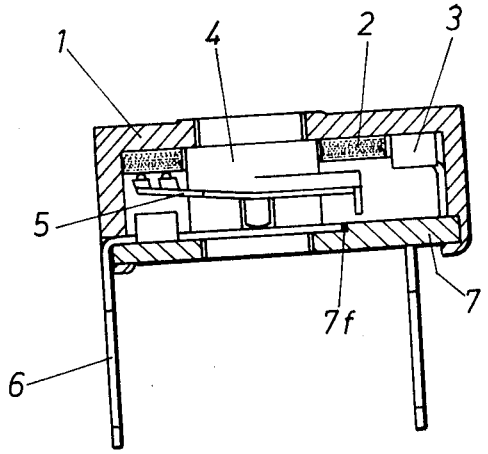

The invention will be described on the basis of the drawing wherein show:

FIG. 1 a disassembled view of a first embodiment of the potentiometer according to the invention;

FIG. 2 a disassembled view of a second embodiment of the potentiometer according to the invention;

FIG. 3 a cross-section of the first embodiment of the assembled potentiometer; and FIG. 4 a cross-section of the second embodiment of the assembled potentiometer.

The housing 1 is made of insulating non-inflammable or self-extinguishing material. On the bottom it has a circular perforation 1*a* serving as a bearing for the shaft 4. Two recesses 1*b* serve for a deepened resting of bent soldering ears 3*a* of both contacts 3 fixed to the sliding ring 2. On the upper circumference of the housing 1 there is a seat 1*c* against which lies a cover 7 at closing the potentiometer. The potentiometer is closed thermically in such manner that the upper circumference of the housing 1*d* is warmed with the assembling tool and then pressed over the cover 7.

The sliding ring 2 can be made of pertinax or ceramics by known processes. For fixing the contacts it has two contact extensions 2*a*. The contacts 3 are cut of thin sheet metal and are galvanically protected as well as easily soldered. Onto the sliding ring 2 they are fixed in such manner that the contact ears 3*a* are bent and subsequently pressed around the contact extensions 2*a*.

The sliding ring 2 with fastened contacts 3 is fixed in such manner that the bent contact ears 3*a* and the sliding ring 2, respectively, lie against the bottom of the housing 1, the cover 7 being pressed against both bent parts of contacts 3*b* whereat the pointed ends 3*c* of contacts pass through the gaps in the cover 7*b*. The length of the broad part of pointed ends 3*c* determines the height of the potentiometer over the printed circuit board.

The axle 4 is made of insulating non-inflammable or self-extinguishing material. With its narrow part 4*f* it is pivoted in the opening 1*a* on the bottom of the housing 1, with the other narrow part 4*g* it being pivoted in the opening 7*a* in the cover 7. The thickened part 4*a* serves for preventing an axial movement.

Both symmetrical side notches 4*b* enable free axial movement of the middle part of the wiper 5 and thereby an undisturbed contact pressure of both bulges 5*b* as used in the first embodiment of the potentiometer or of both bent contact extensions 5*e* as used in the second embodiment of the potentiometer onto the connector 6. The axle also possesses a seat 4*c* for fastening and precisely positioning the wiper 5.

In the first embodiment the axle 4 also possesses a rotation limiter 4*d* projecting from the seat 4*c*, whereas in the second embodiment of the axle 4 between the notches 4*b* a slot 4*h* is positioned in the thickened part 4*a*, intended for receiving the projection 5*f* of the wiper 5 in its second embodiment. The axle 4 has a passage 4*e* with a defined diameter, which enables a rotation with a key (screwdriver) or insertion of an additional rotational element (button, external axle).

The wiper 5 is cut of thin resilient sheet metal. For contacting the resistive layer it has two metal bulges 5*a* with separate spring action, for contacting the conducting ring 6 in the first embodiment it possessing said bulges 5*b* and in the second embodiment it possessing said extensions 5*e*. In the first embodiment of the wiper 5 it also possesses cutouts 5*c* and 5*d* enabling a stable slipping of the wiper 5 onto the axle 4. In the second embodiment the same effect is attained with the projection 5*f*, whereat the bent part 5*g* serves as a rotation limiter. If an unlimited rotation is desired, the height of the rotation limiter 4*d* and 5*g*, respectively, has to be reduced.

The connector 6 is cut of a thin sheet metal and galvanically protected as well as easily soldered. The axle 4 passes through the opening 6*a*.

In the first embodiment the connector 6 has a bent part 6*b* against which abuts the rotation limiter 4*d* of the axle 4. The same function is realized by the two bent parts 6*d* of the second embodiment of the connector 6 against which abuts the said bent part 5*g* of the wiper 5. The connector 6 is lengthened into a contact passing through an opening formed by the notches 1*e* of the housing 1 and 7*c* of the cover 7. The length of the broad part of the pointed end 6*c* defined the height of the potentiometer over the printed circuit board.

The cover 7 is made of insulating non-inflammable or self-extinguishing material. The round opening 7*a* serves as a bearing for the axle 4. Through the slots 7*b* pass the pointed ends 3*c* of contacts. The notch 7*c* serves for the lead out of the connector 6. On the inner side around the opening 7*a* the cover has an elevated seat 7*e* in the first embodiment, in the second embodiment it having a deepening 7*f*, both having a ring shape, whereto and into which, respectively, abuts the connector 6, which is shown in FIGS. 2 and 4, respectively. At closing the potentiometer the warmed material of the circumference of the housing 1*d* is pressed around the outer edges 7*d*.

What is claimed is:

1. An adjustable enclosed potentiometer, characterized in that into a housing, a sliding ring with contacts is inserted and an axle is pivoted in an opening of said housing, said axle extending through a wiper and a connector, the housing being closed with a cover and, said axle having two pivoting narrow parts and a thickened part, said thickened part having two symmetrical side notches, a seat, two notches and a slot, said slot positioned between said notches.

2. An adjustable enclosed potentiometer according to claim 1, characterized in that the housing comprises a circular perforation, two recesses and a seat.

3. An adjustable enclosed potentiometer according to claim 1, characterized in that the contacts are bent and fixed to contact extensions, said extensions having contact ears.

4. An adjustable enclosed potentiometer according to claim 1, characterized in that on the seat, a rotation limiter is positioned.

5. An adjustable enclosed potentiometer according to claim 1, characterized in that the connector has a bent part.

6. An adjustable enclosed potentiometer according to claim 1, characterized in that the connector has two bent parts positioned perpendicular to the plane of the connector.

7. An adjustable enclosed potentiometer according to claim 1, characterized in that the cover has a round opening, two slots and a notch.

8. An adjustable enclosed potentiometer according to claim 7, characterized in that around the opening, a ring-shaped seat is formed.

9. An adjustable enclosed potentiometer according to claim 7, characterized in that around the opening, a ring-shaped deepening is formed.

10. An adjustable enclosed potentiometer, characterized in that into a housing, a sliding ring with contacts is inserted and an axle is pivoted in an opening of said housing, said axle extending through a wiper and a connector, the housing being closed with a cover, said wiper having two contacts and two extensions with bulges, said extensions being on an inner circumference of said wiper.

11. An adjustable enclosed potentiometer according to claim 10, characterized in that the contacts are bent and fixed to contact extensions, said extensions having contact ears.

12. An adjustable enclosed potentiometer according to claim 10, characterized in that the connector has two bent parts positioned perpendicular to the plane of the connector.

13. An adjustable enclosed potentiometer according to claim 10, characterized in that the cover has a round opening, two slots and a notch.

14. An adjustable enclosed potentiometer according to claim 13, characterized in that around the opening, a ring-shaped seat is formed.

15. An adjustable enclosed potentiometer according to claim 13, characterized in that around the opening, a ring-shaped deepening is formed.

16. An adjustable enclosed potentiometer, characterized in that into a housing, a sliding ring with contacts is inserted and an axle is pivoted in an opening of said housing, said axle extending through a wiper and a connector, the housing being closed with a cover, said wiper has two bent extensions and a projection on the inner circumference of said wiper and a bent part on the outer circumference of said wiper serving as a rotation limiter.

17. An adjustable enclosed potentiometer according to claim 16, characterized in that the contacts are bent and fixed to contact extensions, said extensions having contact ears.

18. Adjustable enclosed potentiometer according to claim 16, characterized in that the cover has a round opening, two slots and a notch.

19. Adjustable enclosed potentiometer according to claim 18, characterized in that around the opening, a ring-shaped seat is formed.

20. Adjustable enclosed potentiometer according to claim 18, characterized in that around the opening, a ring-shaped deepening is formed.

* * * * *